US007773925B2

(12) United States Patent
Ikeda

(10) Patent No.: US 7,773,925 B2
(45) Date of Patent: Aug. 10, 2010

(54) IMAGE FORMING APPARATUS

(75) Inventor: Hiroaki Ikeda, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 337 days.

(21) Appl. No.: 12/042,719

(22) Filed: Mar. 5, 2008

(65) Prior Publication Data

US 2008/0304840 A1 Dec. 11, 2008

(30) Foreign Application Priority Data

Mar. 6, 2007 (JP) ..... 2007-055507
Jul. 11, 2007 (JP) ..... 2007-181624

(51) Int. Cl.
*G03G 15/00* (2006.01)
*G03G 15/01* (2006.01)
*G03G 15/16* (2006.01)

(52) U.S. Cl. ..... 399/301; 399/302; 399/303; 399/297; 399/298; 399/162; 399/165

(58) Field of Classification Search ..... 399/301–303, 399/297, 298, 162, 165
See application file for complete search history.

(56) References Cited

U.S. PATENT DOCUMENTS

2006/0263120 A1* 11/2006 Hayakawa ..... 399/301
2007/0110461 A1* 5/2007 Yoshida ..... 399/44
2007/0122210 A1* 5/2007 Sato et al. ..... 399/301
2007/0274745 A1* 11/2007 Ueda et al. ..... 399/301

FOREIGN PATENT DOCUMENTS

JP 2002-244393 8/2002
JP 2003-255626 9/2003

* cited by examiner

*Primary Examiner*—David P Porta
*Assistant Examiner*—Mindy Vu
(74) *Attorney, Agent, or Firm*—Oblon, Spivak, McClelland, Maier & Neustadt, L.L.P.

(57) ABSTRACT

A misregistration correcting unit correcting image misregistration on an endless belt in an electrophotographic image forming apparatus is disclosed that includes an image creation part that creates on the endless belt misregistration correction pattern sets each including a pattern of mark groups each being one of a horizontal line mark group formed of horizontal line segment marks and an oblique line mark group formed of oblique line segment marks; a position detecting part that detects the mark positions; a position detection counting part that counts the number of the detected positions of each mark group and detects an abnormal mark group whose number of the detected positions is other than a prescribed number; a detection result storing part that stores information on the detected mark positions; and a misregistration calculating part that calculates the amount of misregistration based on the stored position information excluding that of the abnormal mark group.

17 Claims, 15 Drawing Sheets

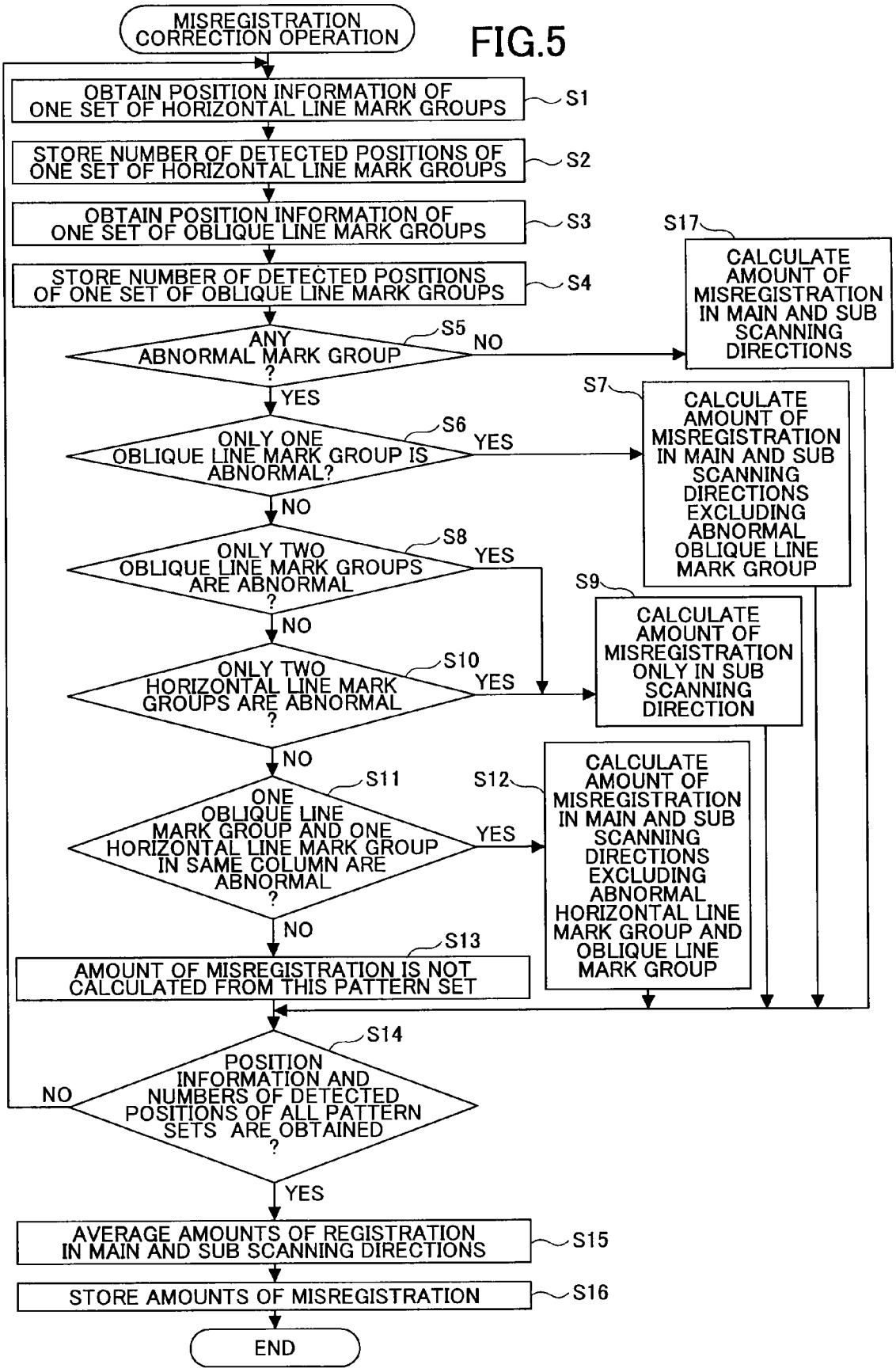
FIG.5
MISREGISTRATION CORRECTION OPERATION
OBTAIN POSITION INFORMATION OF ONE SET OF HORIZONTAL LINE MARK GROUPS
S1
STORE NUMBER OF DETECTED POSITIONS OF ONE SET OF HORIZONTAL LINE MARK GROUPS
S2
OBTAIN POSITION INFORMATION OF ONE SET OF OBLIQUE LINE MARK GROUPS
S3
STORE NUMBER OF DETECTED POSITIONS OF ONE SET OF OBLIQUE LINE MARK GROUPS
S4
ANY ABNORMAL MARK GROUP ?
S5
NO
YES
CALCULATE AMOUNT OF MISREGISTRATION IN MAIN AND SUB SCANNING DIRECTIONS
S17
ONLY ONE OBLIQUE LINE MARK GROUP IS ABNORMAL?
S6
YES
NO
CALCULATE AMOUNT OF MISREGISTRATION IN MAIN AND SUB SCANNING DIRECTIONS EXCLUDING ABNORMAL OBLIQUE LINE MARK GROUP
S7
ONLY TWO OBLIQUE LINE MARK GROUPS ARE ABNORMAL ?
S8
YES
NO
CALCULATE AMOUNT OF MISREGISTRATION ONLY IN SUB SCANNING DIRECTION
S9
ONLY TWO HORIZONTAL LINE MARK GROUPS ARE ABNORMAL ?
S10
YES
NO
ONE OBLIQUE LINE MARK GROUP AND ONE HORIZONTAL LINE MARK GROUP IN SAME COLUMN ARE ABNORMAL ?
S11
YES
NO
CALCULATE AMOUNT OF MISREGISTRATION IN MAIN AND SUB SCANNING DIRECTIONS EXCLUDING ABNORMAL HORIZONTAL LINE MARK GROUP AND OBLIQUE LINE MARK GROUP
S12
AMOUNT OF MISREGISTRATION IS NOT CALCULATED FROM THIS PATTERN SET
S13
POSITION INFORMATION AND NUMBERS OF DETECTED POSITIONS OF ALL PATTERN SETS ARE OBTAINED ?
S14
NO
YES
AVERAGE AMOUNTS OF REGISTRATION IN MAIN AND SUB SCANNING DIRECTIONS
S15
STORE AMOUNTS OF MISREGISTRATION
S16
END

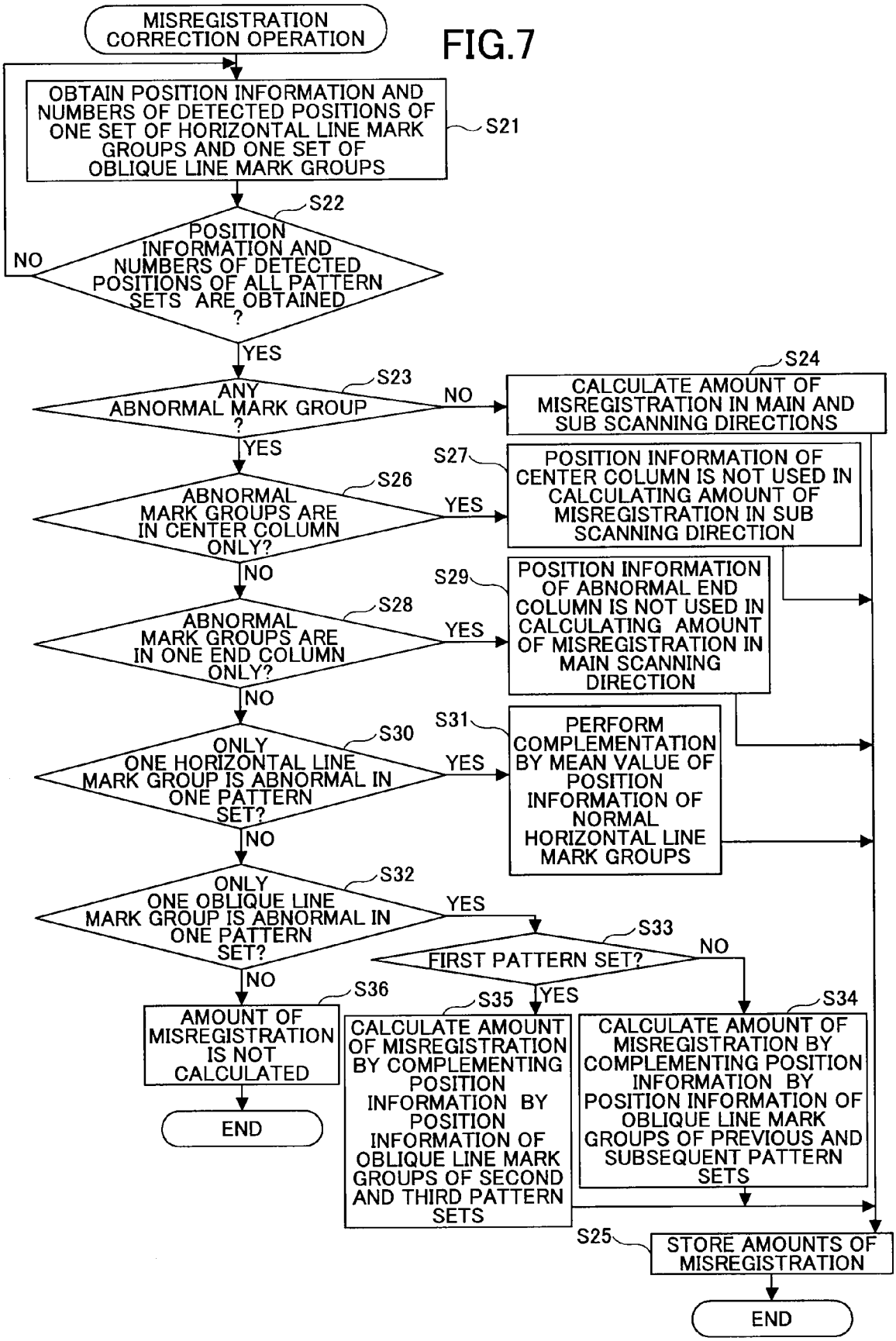
FIG.7
MISREGISTRATION CORRECTION OPERATION
OBTAIN POSITION INFORMATION AND NUMBERS OF DETECTED POSITIONS OF ONE SET OF HORIZONTAL LINE MARK GROUPS AND ONE SET OF OBLIQUE LINE MARK GROUPS
S21
S22
POSITION INFORMATION AND NUMBERS OF DETECTED POSITIONS OF ALL PATTERN SETS ARE OBTAINED ?
NO
YES
S23
ANY ABNORMAL MARK GROUP ?
NO
S24
CALCULATE AMOUNT OF MISREGISTRATION IN MAIN AND SUB SCANNING DIRECTIONS
YES
S26
ABNORMAL MARK GROUPS ARE IN CENTER COLUMN ONLY?
YES
S27
POSITION INFORMATION OF CENTER COLUMN IS NOT USED IN CALCULATING AMOUNT OF MISREGISTRATION IN SUB SCANNING DIRECTION
NO
S28
ABNORMAL MARK GROUPS ARE IN ONE END COLUMN ONLY?
YES
S29
POSITION INFORMATION OF ABNORMAL END COLUMN IS NOT USED IN CALCULATING AMOUNT OF MISREGISTRATION IN MAIN SCANNING DIRECTION
NO
S30
ONLY ONE HORIZONTAL LINE MARK GROUP IS ABNORMAL IN ONE PATTERN SET?
YES
S31
PERFORM COMPLEMENTATION BY MEAN VALUE OF POSITION INFORMATION OF NORMAL HORIZONTAL LINE MARK GROUPS
NO
S32
ONLY ONE OBLIQUE LINE MARK GROUP IS ABNORMAL IN ONE PATTERN SET?
YES
S33
FIRST PATTERN SET?
NO
YES
NO
S36
AMOUNT OF MISREGISTRATION IS NOT CALCULATED
END
S35
CALCULATE AMOUNT OF MISREGISTRATION BY COMPLEMENTING POSITION INFORMATION BY POSITION INFORMATION OF OBLIQUE LINE MARK GROUPS OF SECOND AND THIRD PATTERN SETS
S34
CALCULATE AMOUNT OF MISREGISTRATION BY COMPLEMENTING POSITION INFORMATION BY POSITION INFORMATION OF OBLIQUE LINE MARK GROUPS OF PREVIOUS AND SUBSEQUENT PATTERN SETS
S25
STORE AMOUNTS OF MISREGISTRATION
END

IMAGE FORMING APPARATUS

BACKGROUND OF THE INVENTION

1. Field of the Invention

The present invention relates generally to image forming apparatuses, and more particularly to an image forming apparatus, such as a printer, of an electrophotography type that performs misregistration correction in producing a visualized image by superposing multiple colors.

2. Description of the Related Art

In conventional image forming apparatuses, image forming parts of respective colors are arranged along a belt conveyor (endless moving part) as shown in FIG. 1. This is called a tandem type. That is, multiple image forming parts (electrophotographic process parts) 6Y, 6M, 6C, and 6BK are arranged along a belt conveyor 5 in this order from the upstream side in the direction in which the belt conveyor 5 conveys sheets of paper (recording paper) 4 separated and fed one by one from a paper feed tray 1 by a paper feed roller 2 and separation rollers 3. These image forming parts 6Y, 6M, 6C, and 6BK are different only in the color of a formed toner image and are equal in internal configuration. The image forming part 6Y forms a yellow image, the image forming part 6M forms a magenta image, the image forming part 6C forms a cyan image, and the image forming part 6BK forms a black image.

A specific description is given of the image forming part 6Y. The other image forming parts 6M, 6C, and 6BK have the same configuration as the image forming part 6Y. Accordingly, the elements of each of the image forming parts 6M, 6C, and 6BK are referred to in the drawing by the same reference numerals as those of the corresponding elements of the image forming part 6Y except that the suffix Y is replaced with the suffix of the corresponding color M, C, or BK, and a description thereof is omitted.

The belt conveyor 5 is an endless belt wound around a driving roller 7 and a driven roller 8. The driving roller 7 is rotated by a drive motor (not graphically illustrated). This drive motor, the driving roller 7, and the driven roller 8 serve as a driving part that moves the belt conveyor 5 that is an endless moving part.

In image formation, the sheets of paper (paper sheets) 4 contained in the paper feed tray 1 are fed in order starting from the uppermost paper sheet. The fed paper sheet 4 is attracted and adhered to the belt conveyor 5 by electrostatic adhesion, and conveyed by the rotating belt conveyor 5 to the first image forming part 6Y, where a yellow toner image is transferred onto the paper sheet 4.

The image forming part 6Y includes a photosensitive body drum 9Y serving as a photosensitive body, and a charger 10Y, an exposure unit 11, a developing unit 12Y, a photosensitive body cleaner (not graphically illustrated), and a discharger 13Y disposed around the photosensitive body drum 9Y. The exposure unit 11 is configured to emit laser lights 14Y, 14M, 14C, and 14BK that are exposure lights corresponding to the colors of images formed by the image forming parts 6Y, 6M, 6C, and 6BK, respectively.

In image formation, after being evenly charged by the charger 10Y in the dark, the exterior (cylindrical) surface of the photosensitive body drum 9Y is exposed to the laser light 14Y corresponding to a yellow toner image from the exposure unit 11, so as to have an electrostatic latent image formed thereon. The developing unit 12Y visualizes this electrostatic latent image with yellow toner, so that the yellow toner image is formed on the photosensitive body drum 9Y. This toner image is transferred onto the paper sheet 4 through the action of a transfer unit 15Y at a transfer position, that is, a position where the photosensitive body drum 9Y and the paper sheet 4 on the belt conveyor 5 come into contact with each other. As a result of this transfer, the yellow toner image is formed on the paper sheet 4. After the transfer of the toner image is completed, unnecessary toner remaining on the external surface of the photosensitive body drum 9Y is wiped off (removed) by the photosensitive body cleaner. Thereafter, the photosensitive body drum 9Y is discharged by the discharger 13Y, and stands by for the next image forming operation.

The paper sheet 4 having the yellow toner image transferred thereonto in the image forming part 6Y in the above-described manner is conveyed to the next image forming part 6M by the belt conveyor 5. In the image forming part 6M, a magenta toner image is formed on a photosensitive body drum 9M by the same image forming process as the image forming process in the image forming part 6Y, and the magenta toner image is transferred so as to be superposed on the yellow toner image formed on the paper sheet 4.

The paper sheet 4 is further conveyed to the next image forming parts 6C and 6BK, so that a cyan toner image formed on a photosensitive body drum 9C and a black toner image formed on a photosensitive body drum 9BK are transferred onto the paper sheet 4 in a superposed manner by the same operations. As a result, a full color image is formed on the paper sheet 4. The paper sheet 4 having this full color composite image formed thereon is separated from the belt conveyor 5 and has the full color image fixed thereonto in a fuser 16. Thereafter, the paper sheet 4 is ejected outside the image forming apparatus.

In the color image forming apparatus having the above-described configuration, there may be a problem in that the toner images of respective colors are not superposed where they are supposed to be because of errors such as center distance errors of the photosensitive body drums 9Y, 9M, 9C, and 9BK, parallelism errors of the photosensitive body drums 9Y, 9M, 9C, and 9BK, provision errors of deflection mirrors (not graphically illustrated) that deflect the laser lights 14Y, 14M, 14C, and 14BK in the exposure unit 11, and timing errors in writing electrostatic latent images onto the photosensitive body drums 9Y, 9M, 9C, and 9BK, so that misregistration may be caused between colors. Skew, misregistration in the sub scanning direction, magnification error in the main scanning direction, and misregistration in the main scanning direction are known as principal components of color misregistration. Therefore, it is necessary to correct misregistration (misalignment) of each color toner image. As shown in FIG. 1, sensors 17, 18, and 19 are provided on the downstream side of the image forming part 6BK so as to face the belt conveyor 5. The sensors 17, 18, and 19 are supported by the same substrate so as to be along the main scanning direction perpendicular to the direction in which the paper sheet 4 is conveyed.

FIG. 2A is a diagram showing image detecting (sensing) parts (including the sensors 17, 18, and 19) and their periphery. FIG. 2B is an enlarged view of one of the image detecting parts.

Referring to FIG. 2A, the image detecting parts are provided at both ends and in the center in the main scanning direction, and marks for detecting misregistration (misregistration detection marks) 23 (23*a*, 23*b*, and 23*c*) are formed on the belt conveyor 5 for the corresponding image detecting parts.

Referring to FIG. 2B, each image detecting part includes a light emitting part 20, a slit 21, and a light receiving part 22, and detects (senses) the corresponding misregistration detection mark 23 formed on the belt conveyor 5.

FIG. 2C is an enlarged view of the slit 21. In order to detect a line parallel to the main scanning direction (parallel line) and a line inclined with respect to the parallel line (inclined line), the slit 21 includes openings parallel to the parallel line and the inclined line.

FIG. 3A is an enlarged view of the misregistration detection marks 23. Each misregistration mark 23 includes parallel and inclined lines of each of K (BK), M, Y, and C. The parallel and inclined lines are formed with a target of a predetermined distance d between all adjacent parallel lines and between all adjacent inclined lines. As a result, a detection signal has a well-shaped peak or valley waveform when the line reaches the corresponding opening of the slit 21, so that it is possible to determine the center of the line with accuracy.

FIG. 3B shows a configuration for processing data thus detected. A CPU 31 performs a predetermined operation based on the results of detection of the misregistration detection marks 23, so that the amounts of skew, misregistration in the sub scanning direction, magnification error in the main scanning direction, and misregistration in the main scanning direction are determined. Correction is performed based on these results. With respect to skew, for example, an inclination is added to a deflection mirror in the exposure unit 11 or to the exposure unit 11 itself through an actuator. With respect to misregistration in the sub scanning direction, correction is performed, for example, by controlling writing start timing of lines and the surface phase of a polygon mirror. With respect to magnification error in the main scanning direction, correction is performed, for example, by changing a writing image frequency. With respect to misregistration in the main scanning direction, correction is performed by correcting writing start timing of main scanning lines.

FIG. 3A shows a minimum set of mark columns required to determine various amounts of color misregistration of each color. Alternatively, in order to cancel variation error due to variations in the rotations of a photosensitive body, an intermediate transfer belt, and/or a belt conveyor, for example, multiple sets of mark groups may be formed with respect to the period of one rotation of the photosensitive body. The sensors 17, 18, and 19 may detect the mark groups, and the detection results may be averaged. As a result, it is possible to perform detection with more accuracy.

Further, a description is given, with reference to FIG. 3B, of an operation for processing the detected data. A signal obtained from the light-receiving part 22 is amplified by an amplifier (AMP) 24, and only its signal component of line detection is transmitted through a filter 25 so as to be converted from analog data into digital data by an analog-to-digital (A/D) converter part 26. The sampling of data is controlled by a sampling control part 27, and the sampled data are stored in a FIFO memory 28. After detection of one set of misregistration detection marks 23 is completed, the stored data are loaded into the CPU 31 and a RAM 32 through an I/O port 29 and a data bus 30, and the CPU 31 performs a predetermined operation on the data to determine the above-described various amounts of misregistration.

A ROM 33 contains various programs for controlling a misregistration correction unit and the image forming apparatus, such as programs for calculating the above-described various amounts of misregistration. Further, the CPU 31 is properly timed to monitor the detection signal from the light-receiving part 22 so that the amount of light emission is controlled by a light emission amount control part 34 so as to ensure the detection even if the belt conveyor 5 or the light emission part 20 is degraded, thereby causing the level of the light reception signal from the light-receiving part 22 to be always constant. Thus, the CPU 31 and the ROM 33 serve as a control part to control the operation of the entire image forming apparatus. Examples of the conventional techniques related to this are shown below.

According to Patent Document 1 listed below, a disclosed color image forming apparatus prevents misregistration from remaining after correcting misregistration of each color. Toner images of respective colors are formed by an image process part. The color toner images are superposed on a transfer belt so as to form a color image to be transferred (transfer color image). The transfer color image is transferred onto transfer paper. Correction patterns formed on the transfer belt are detected and recognized so as to calculate a correction value. In order to prevent misregistration of each color, this correction value is added in controlling the driving of a part to be driven. A value input from an input part such as an operations panel is added to this correction value so as to determine a final correction value. Thus, according to Patent Document 1, in forming a color image on the transfer paper, by controlling the driving of the part to be driven based on the determined final correction value, it is possible to eliminate misregistration of each color with more certainty and to obtain a color image without misregistration of any color.

According to Patent Document 2 listed below, an image forming apparatus disclosed therein corrects image distortion or color misregistration of a color image with high accuracy with respect to each pixel of the entire image. Pattern data are generated so that test patterns are formed at predetermined positions on recording paper. Misregistration at feature points included in the test patterns are detected from image data obtained by reading the recording paper having an image formed thereon with the test patterns added thereto. After correcting a deviation or inclination at the time of reading by image reading means, misregistration of the feature points from where they are supposed to be output are detected. An operation value for correcting each pixel is calculated by referring to the detected misregistration of the feature points. An operation for eliminating misregistration of each pixel at the time of image formation is performed using the operation value.

[Patent Document 1] Japanese Laid-Open Patent Application No. 2002-244393

[Patent Document 2] Japanese Laid-Open Patent Application No. 2003-255626

However, conventional methods of correcting misregistration have the following problems. That is, even when misregistration correction is performed at one occasion, misregistration remains until the next occasion and a lack of document information is caused if formed correction patterns are over-detected or under-detected so as to prevent correction (amount) of misregistration from being calculated. Further, an attempt of perform another misregistration correction prolongs time for misregistration correction so as to reduce printing operation time.

SUMMARY OF THE INVENTION

Embodiments of the present invention may solve or reduce one or more of the above-described problems.

According to one embodiment of the present invention, there is provided an image forming apparatus in which one or more of the above-described problems may be solved or reduced.

According to one embodiment of the present invention, there is provided an easy-to-use image forming apparatus that prevents occurrence of misregistration.

According to one embodiment of the present invention, there is provided a misregistration correcting unit correcting a misregistration of an image on an endless belt in an electrophotographic image forming apparatus, the misregistration correcting unit including an image creation part configured to create a plurality of pattern sets for correcting the misregistration on the endless belt, the pattern sets each including a pattern of a plurality of mark groups arranged in a plurality of columns and a plurality of rows, the mark groups each being one of a horizontal line mark group formed of a plurality of marks each formed of a horizontal line segment and an oblique line mark group formed of a plurality of marks each formed of an oblique line segment; a position detecting part configured to detect positions of the marks; a position detection counting part configured to count a number of the detected positions of each of the mark groups and detect an abnormal one or more of the mark groups whose numbers of the detected positions are other than a prescribed number; a detection result storing part configured to store position information, the position information being information on the positions of the marks detected by the position detecting part; and a misregistration calculating part configured to calculate an amount of the misregistration based on the stored position information excluding the position information of the abnormal one or more of the mark groups.

According to one embodiment of the present invention, there is provided a misregistration correction controlling method correcting a misregistration of an image on an endless belt in an electrophotographic image forming apparatus, the misregistration correction controlling method including creating a plurality of pattern sets for correcting the misregistration on the endless belt, the pattern sets each including a pattern of a plurality of mark groups arranged in a plurality of columns and a plurality of rows, the mark groups each being one of a horizontal line mark group formed of a plurality of marks each formed of a horizontal line segment and an oblique line mark group formed of a plurality of marks each formed of an oblique line segment; detecting positions of the marks and storing position information on a pattern set basis, the position information being information on the positions of the marks; counting a number of the detected positions of each of the mark groups and determining whether there is an abnormal mark group whose number of the detected positions is other than a prescribed number; calculating an amount of the misregistration, in one or more of the pattern sets where only one of the oblique line mark groups is abnormal, by excluding the position information of the abnormal one of the oblique line mark groups; calculating the amount of the misregistration only in a sub scanning direction in one or more of the pattern sets where only two or more of the oblique line mark groups are abnormal and in one or more of the pattern sets where only two or more of the horizontal line mark groups are abnormal; and calculating the amount of the misregistration, in one or more of the pattern sets where an abnormal one of the horizontal line mark groups and an abnormal one of the oblique line mark groups are in a same column, by excluding the position information of the abnormal one of the horizontal line mark groups and the abnormal one of the oblique line mark groups.

According to one embodiment of the present invention, there is provided a misregistration correction controlling method correcting a misregistration of an image on an endless belt in an electrophotographic image forming apparatus, the misregistration correction controlling method including creating a plurality of pattern sets for correcting the misregistration on the endless belt, the pattern sets each including a pattern of a plurality of mark groups arranged in a plurality of columns and a plurality of rows, the mark groups each being one of a horizontal line mark group formed of a plurality of marks each formed of a horizontal line segment and an oblique line mark group formed of a plurality of marks each formed of an oblique line segment; detecting positions of the marks of each of the pattern sets and storing position information, the position information being information on the positions of the marks; counting a number of the detected positions of each of the mark groups and determining whether there is an abnormal mark group whose number of the detected positions is other than a prescribed number; calculating an amount of the misregistration in a sub scanning direction, in response to the abnormal mark group being in an inner column only, by excluding the position information of the inner column; calculating the amount of the misregistration in a main scanning direction, in response to the abnormal mark group being in only one of end columns, by excluding the position information of the one of the end columns; calculating the amount of the misregistration, in one or more of the pattern sets where only one of the horizontal line mark groups is abnormal, by complementing the position information of the abnormal one of the horizontal line mark groups by the position information of the other horizontal line mark groups; calculating the amount of the misregistration, in response to only one of the mark groups being abnormal, by using a mean value of the position information of the other normal mark groups as complementary position information; calculating the amount of the misregistration, in one or more of the pattern sets where only one of the oblique line mark groups is abnormal, by complementing the position information of the abnormal one of the oblique line mark groups by the position information of a corresponding one of the oblique line mark groups of each of a previous one and a subsequent one of the pattern sets; calculating the amount of the misregistration, in response to only one of the oblique line mark groups being abnormal in a first one of the pattern sets, by calculating complementary position information from the position information of the corresponding one of the oblique line mark groups of each of a second one and a third one of the pattern sets, the second one following the first one and the third one following the second one; and calculating the amount of the misregistration, in response to only one of the oblique line mark groups being abnormal in an intermediate one of the pattern sets, by calculating complementary position information from the position information of the corresponding one of the oblique line mark groups of each of the pattern sets immediately before and after the intermediate one.

According to one aspect of the present invention, misregistration is prevented from occurring, and the misregistration correction time is prevented from being prolonged, thus resulting in better usability.

BRIEF DESCRIPTION OF THE DRAWINGS

Other objects, features and advantages of the present invention will become more apparent from the following detailed description when read in conjunction with the accompanying drawings, in which:

FIG. 5 is a flowchart showing an operational procedure for the method of correcting misregistration performed in the image forming apparatus according to the first embodiment of the present invention;

FIG. 7 is a flowchart showing an operational procedure for a method of correcting misregistration performed in an image forming apparatus according to a second embodiment of the present invention;

DETAILED DESCRIPTION OF THE PREFERRED EMBODIMENTS

A description is given below, with reference to the accompanying drawings, of embodiments of the present invention.

First Embodiment

According to a first embodiment of the present invention, there is provided an image forming apparatus that creates multiple sets of patterns for misregistration correction on an endless belt; detects the positions of marks and stores the position information pattern set by pattern set; counts the number of detected positions mark group by mark group; and calculates the amount of misregistration excluding the position information of an abnormal mark group pattern set by pattern set.

The image forming apparatus according to the first embodiment of the present invention has the same basic configuration as the conventional one.

Figure 1:
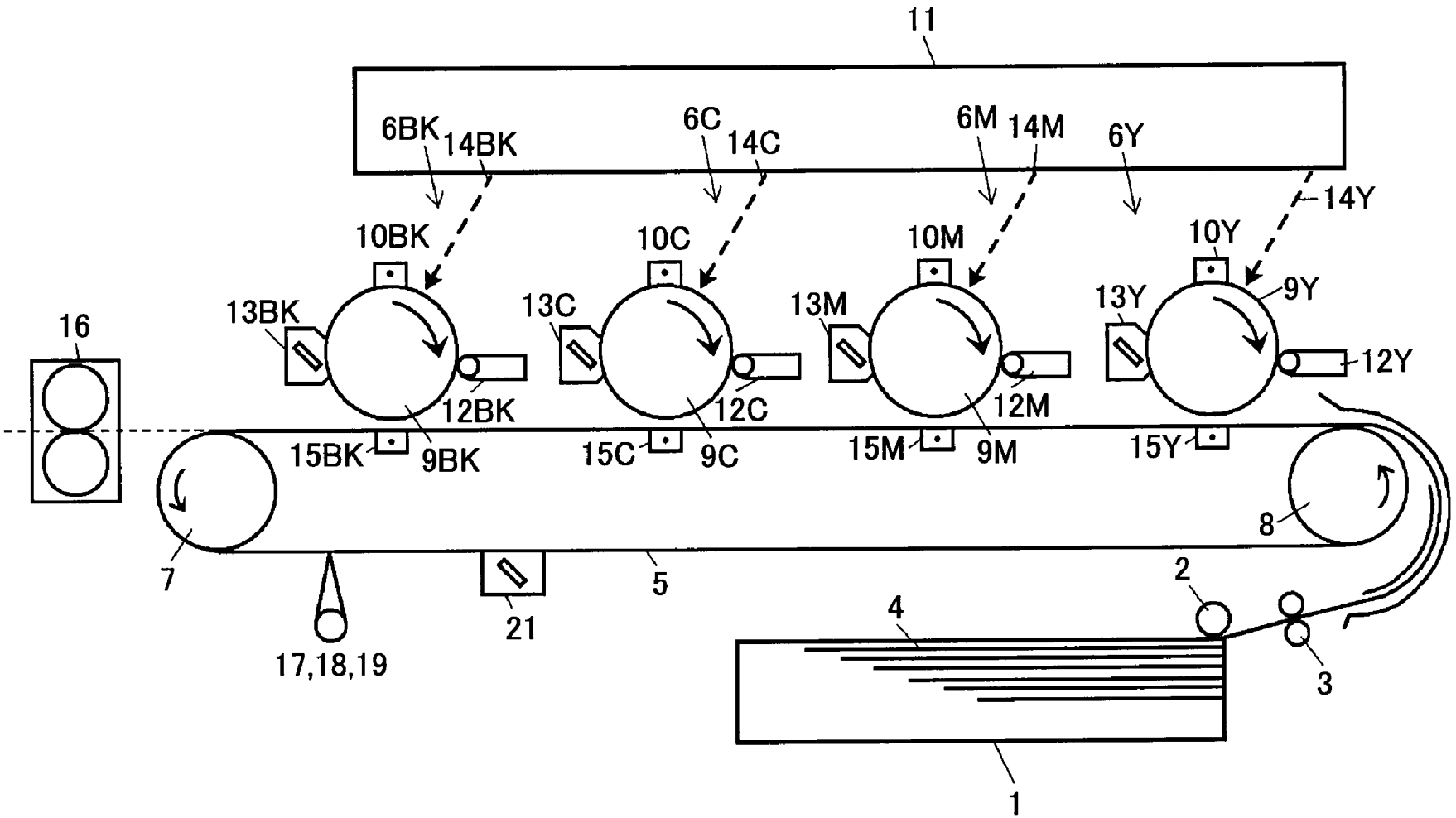
FIG. 1 is a schematic diagram showing a conventional image forming apparatus.
Figure 2A:
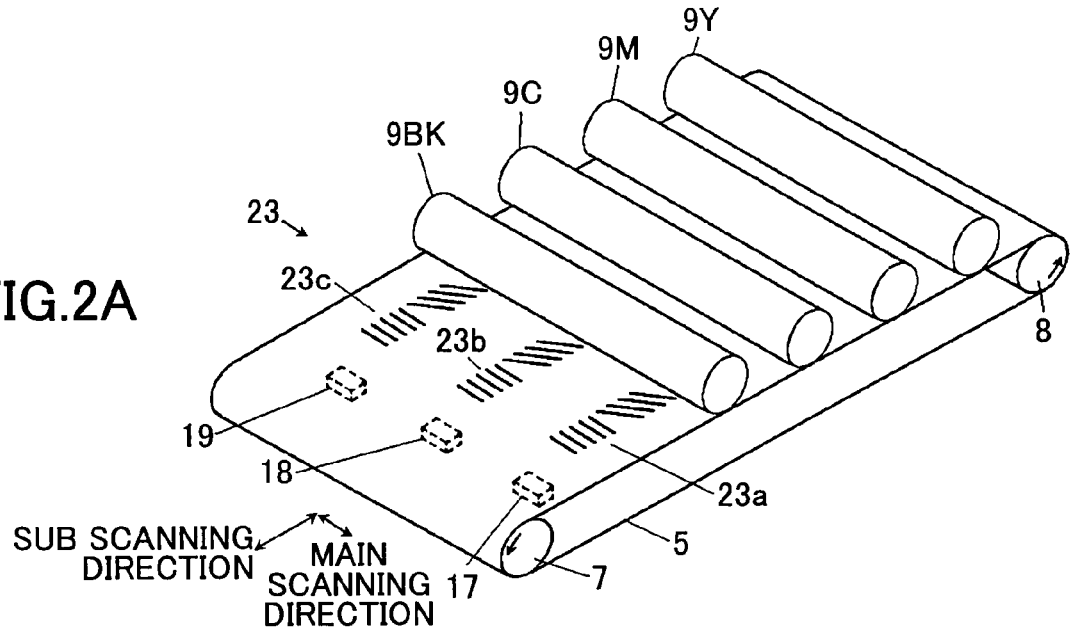
FIG. 2A is a diagram showing image detecting parts and their periphery of the conventional image forming apparatus.
Figure 2B:
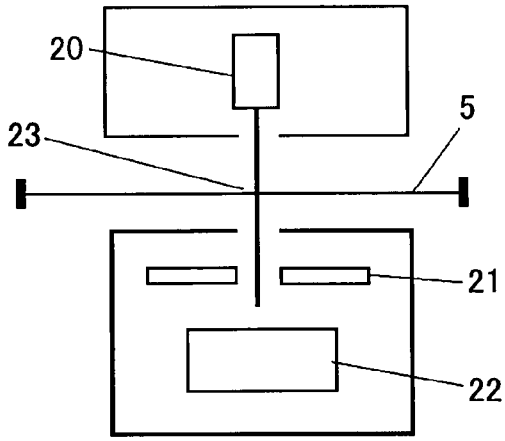
FIG. 2B is an enlarged view of one of the image detecting parts.
Figure 2C:
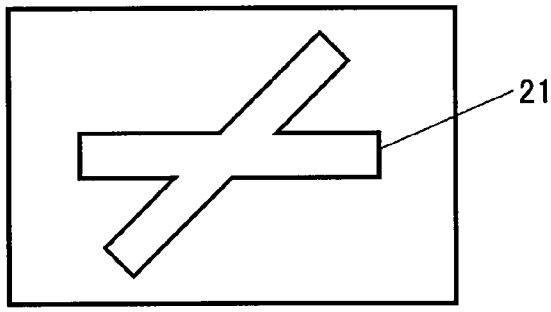
FIG. 2C is an enlarged view of a slit of the image detecting part.
Figure 3A:
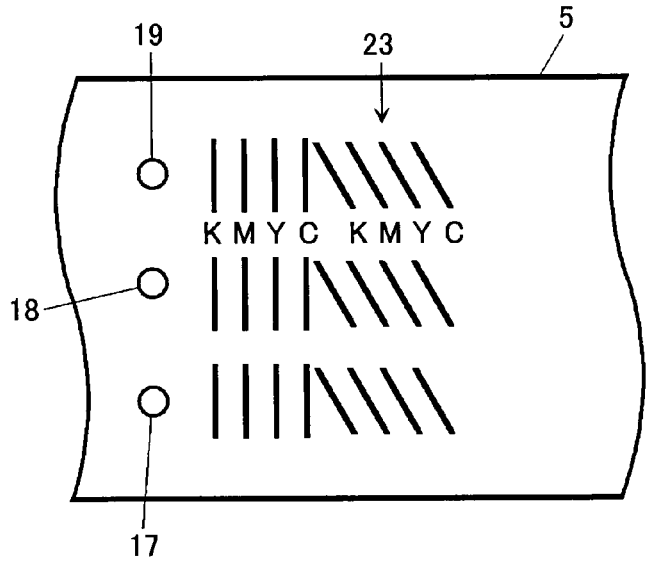
FIG. 3A is an enlarged view of detection marks of the conventional image forming apparatus.
Figure 3B:
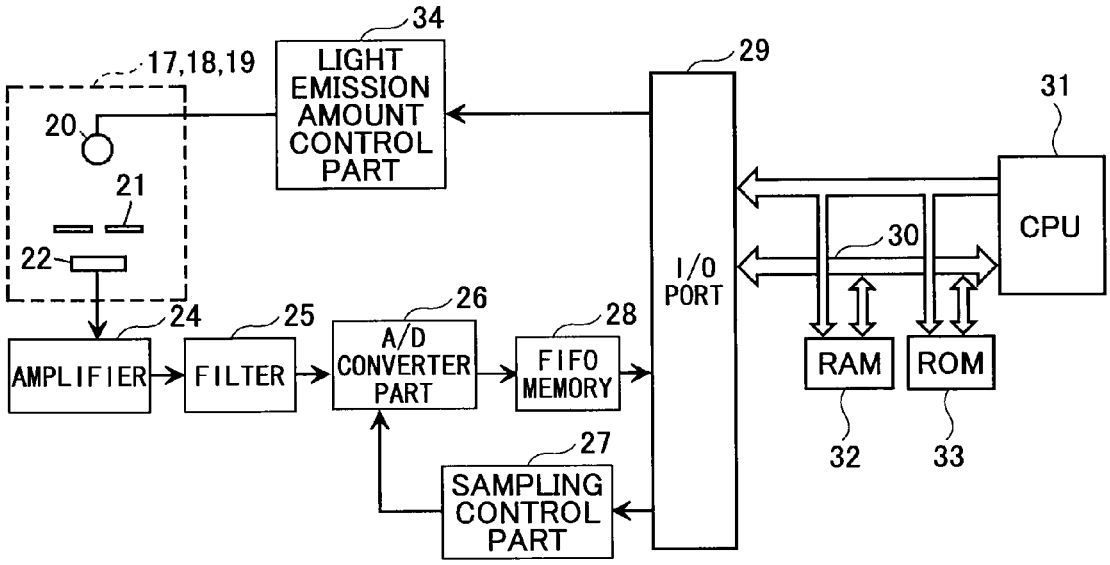
FIG. 3B is a diagram showing a configuration for processing detected data.
Figure 4:
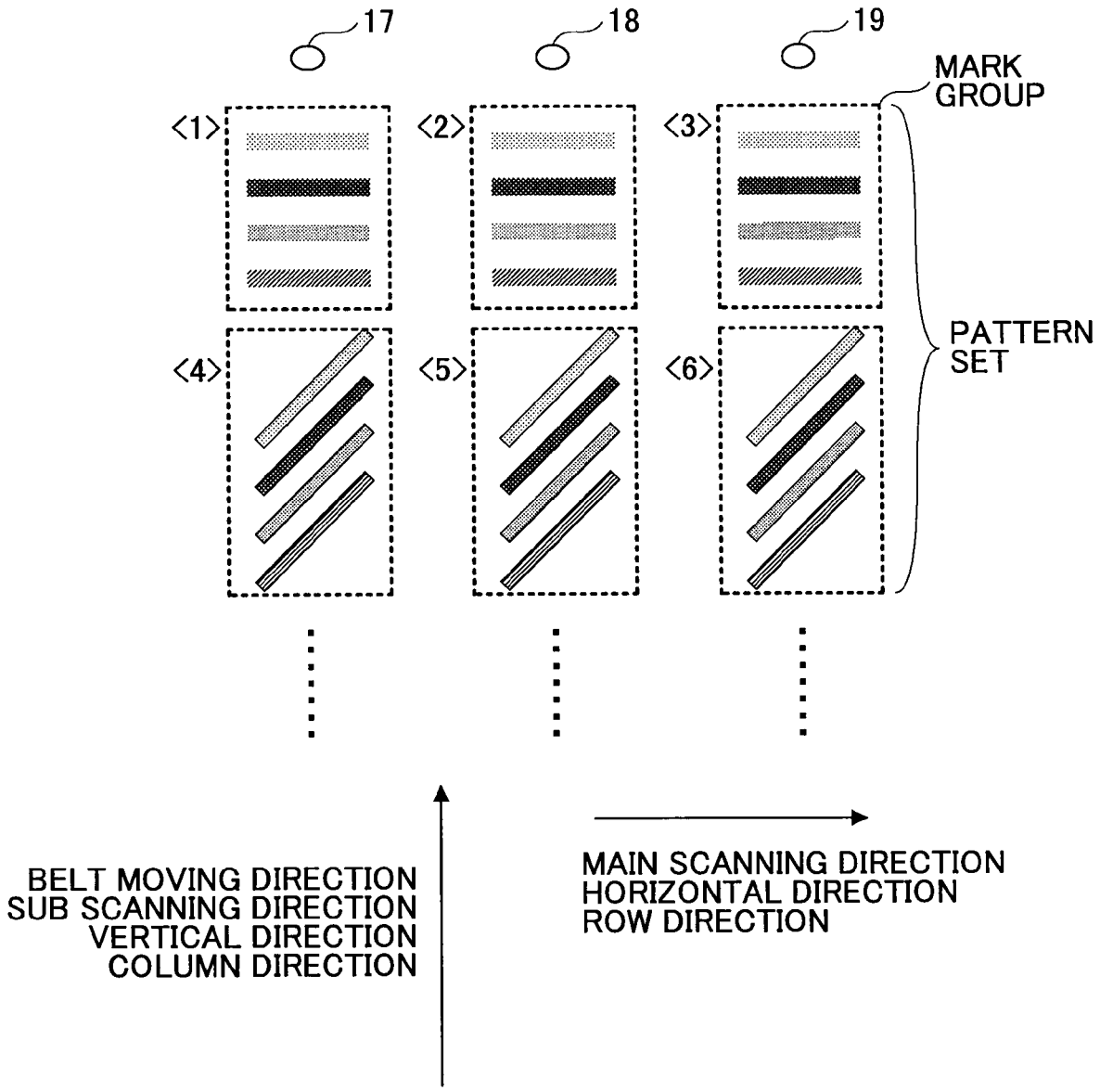
FIG. 4 is a diagram for illustrating a method of correcting misregistration in an image forming apparatus according to a first embodiment of the present invention.
Figure 6A:
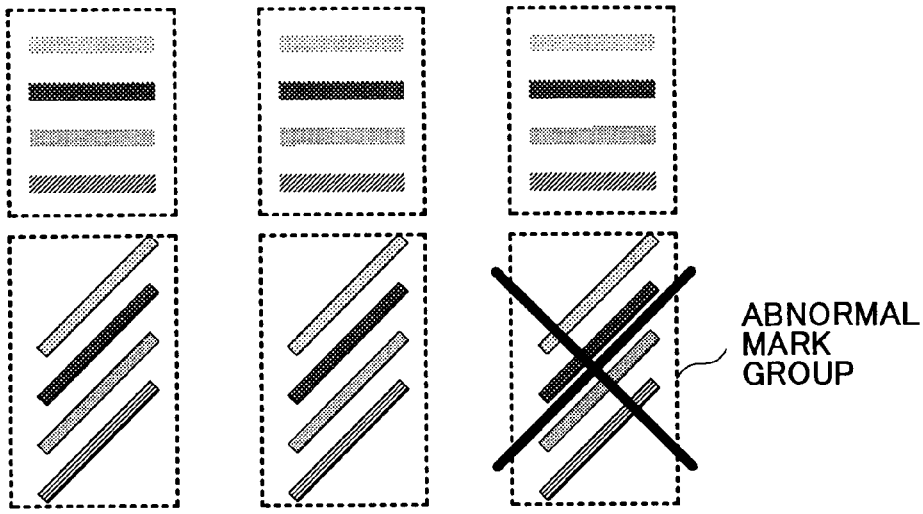
FIGS. 6A through 6D are diagrams for illustrating abnormal mark groups to be excluded in the method of correcting misregistration performed in the image forming apparatus according to the first embodiment of the present invention.
Figure 6B:
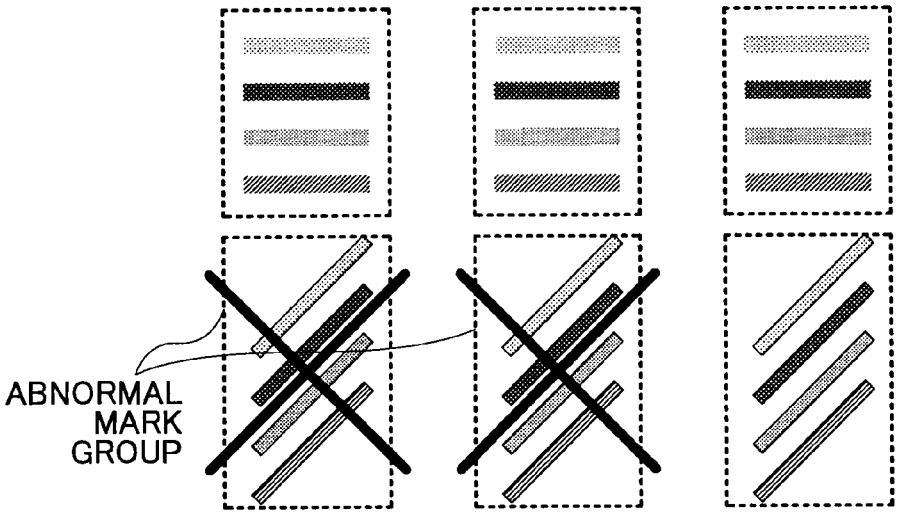
Figure 6C:
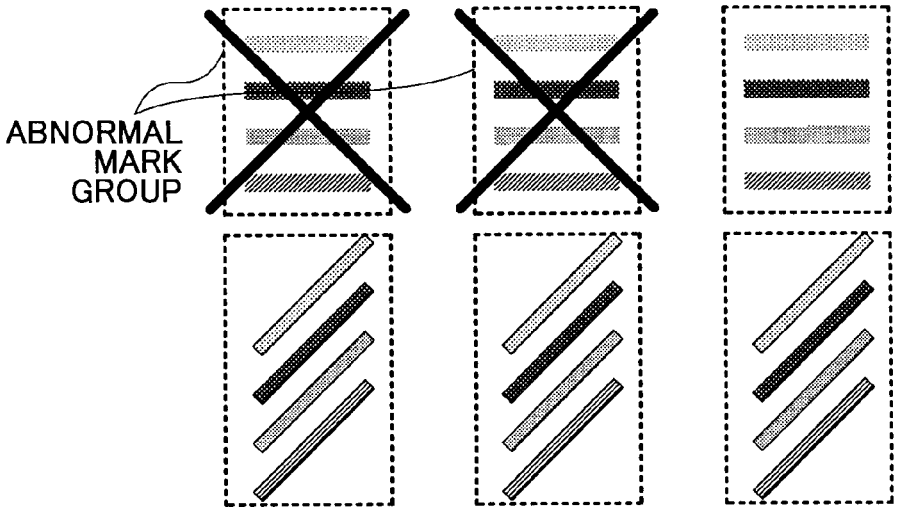
Figure 6D:
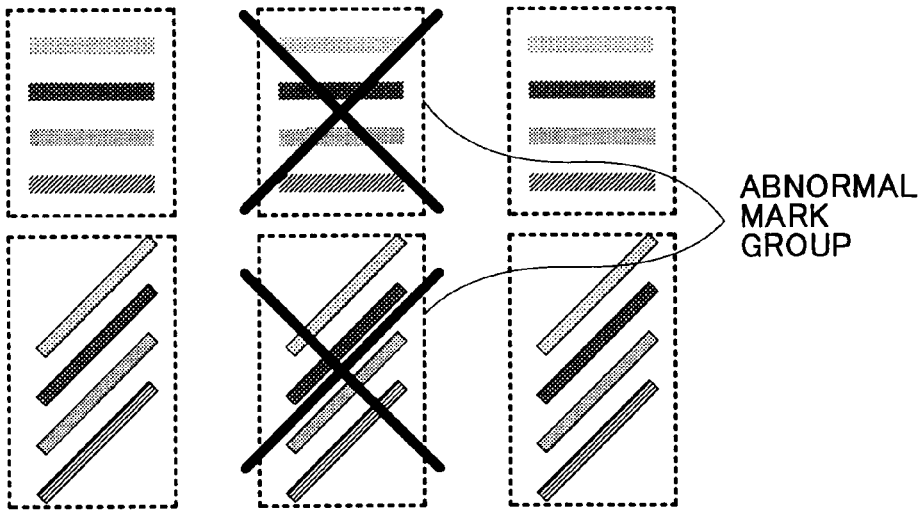
Figure 8A:
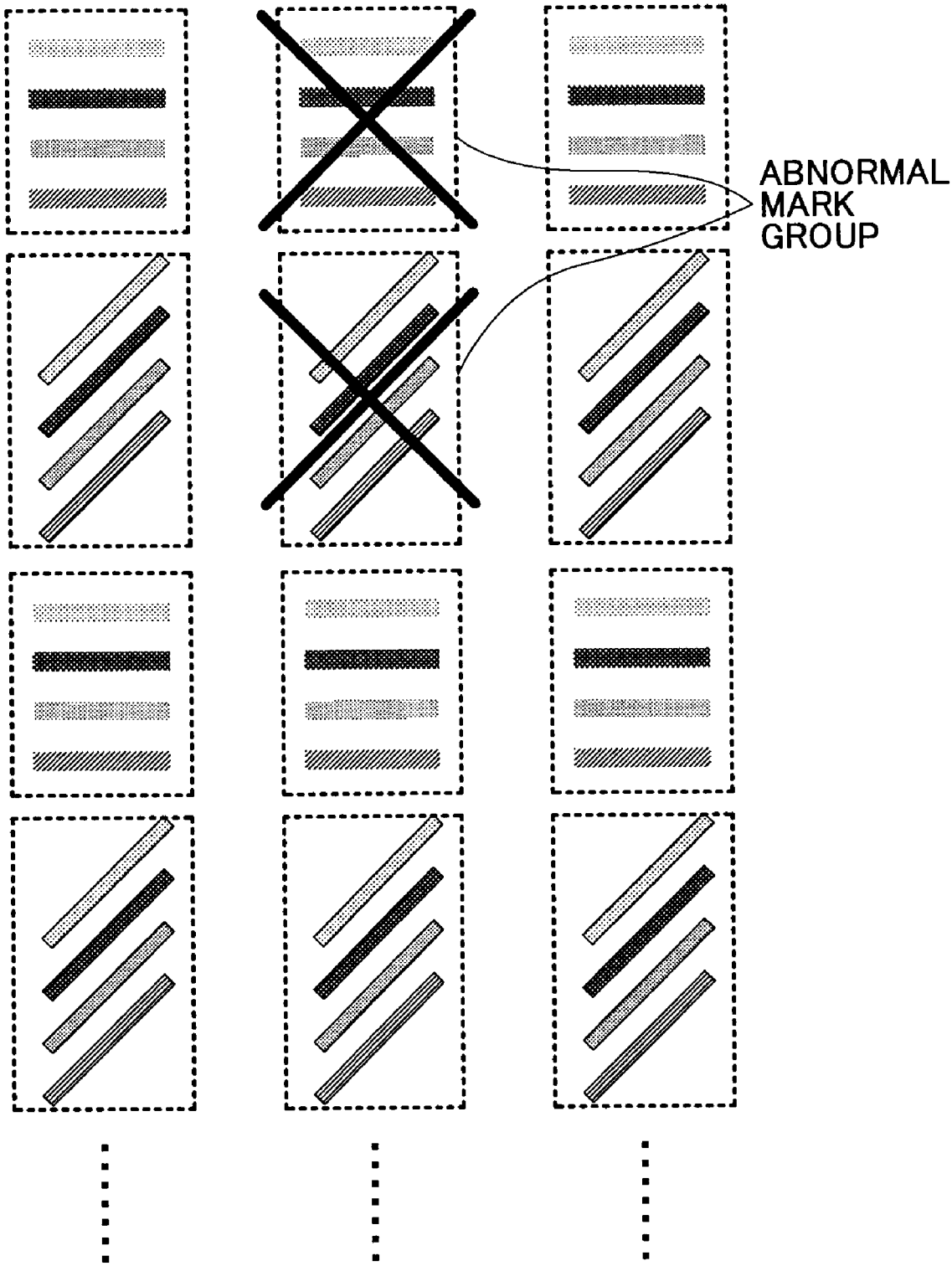
FIGS. 8A through 8D are diagrams for illustrating abnormal mark groups to be excluded in the method of correcting misregistration performed in the image forming apparatus according to the second embodiment of the present invention.
Figure 8B:
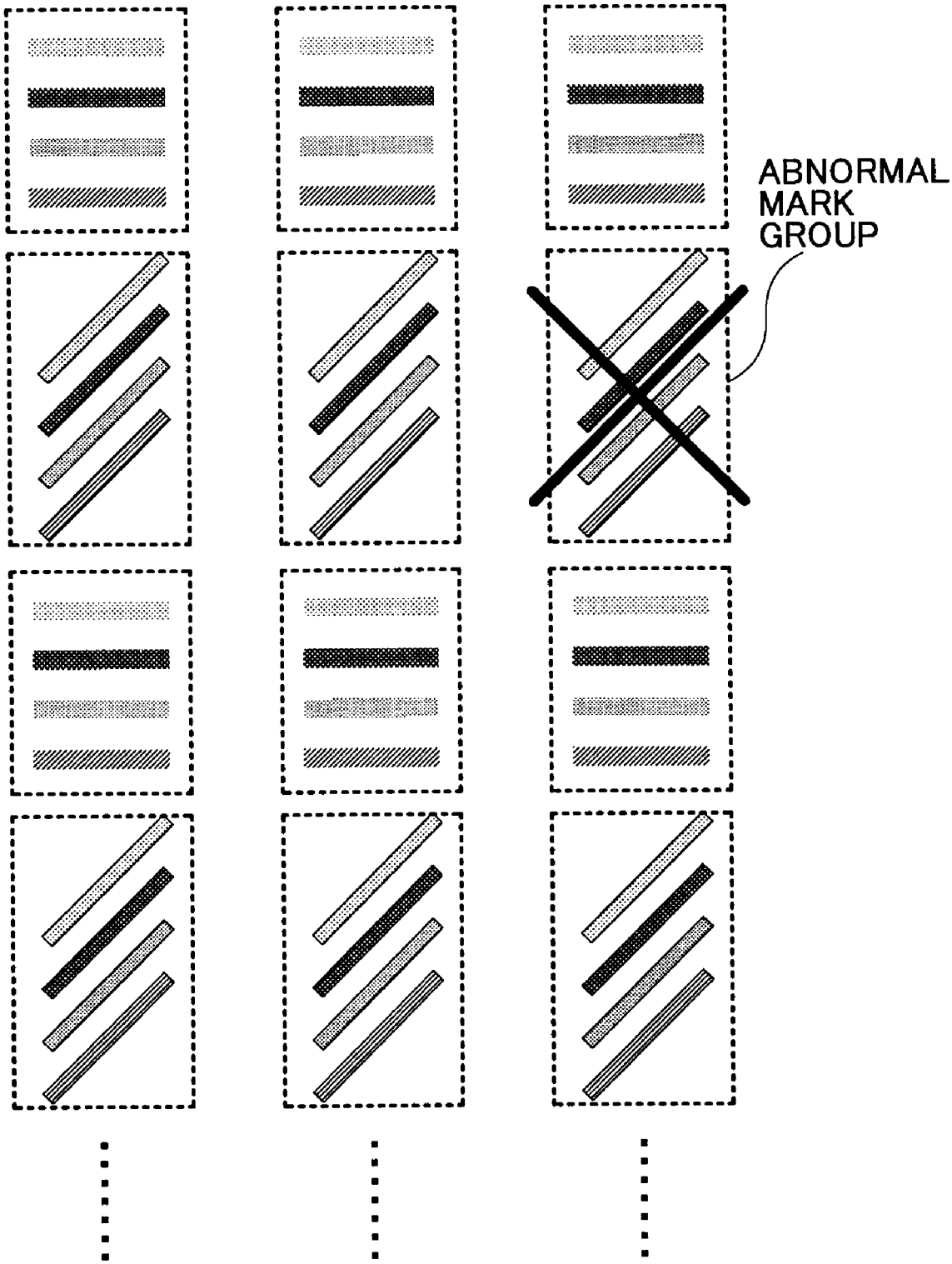
Figure 8C:
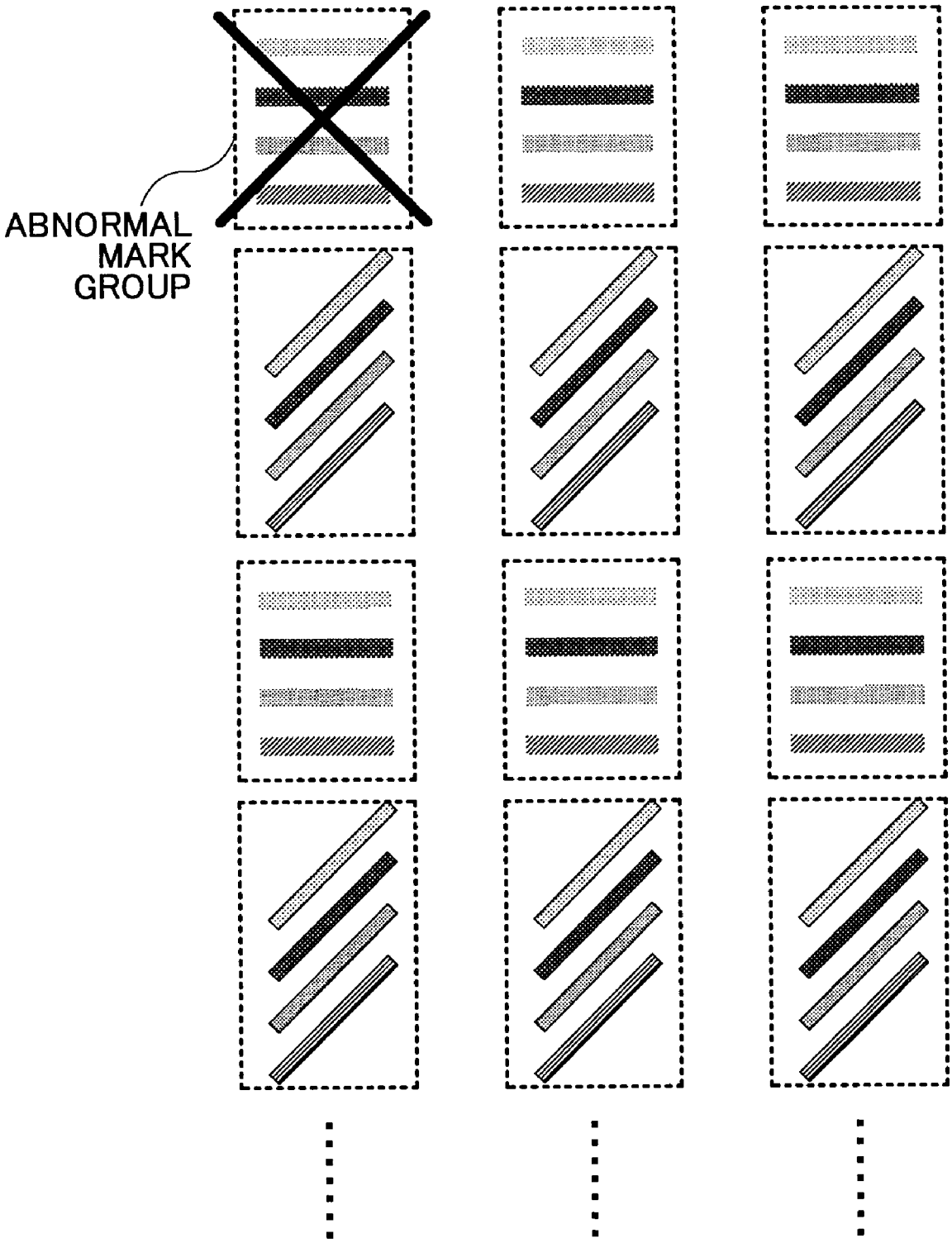
Figure 8D:
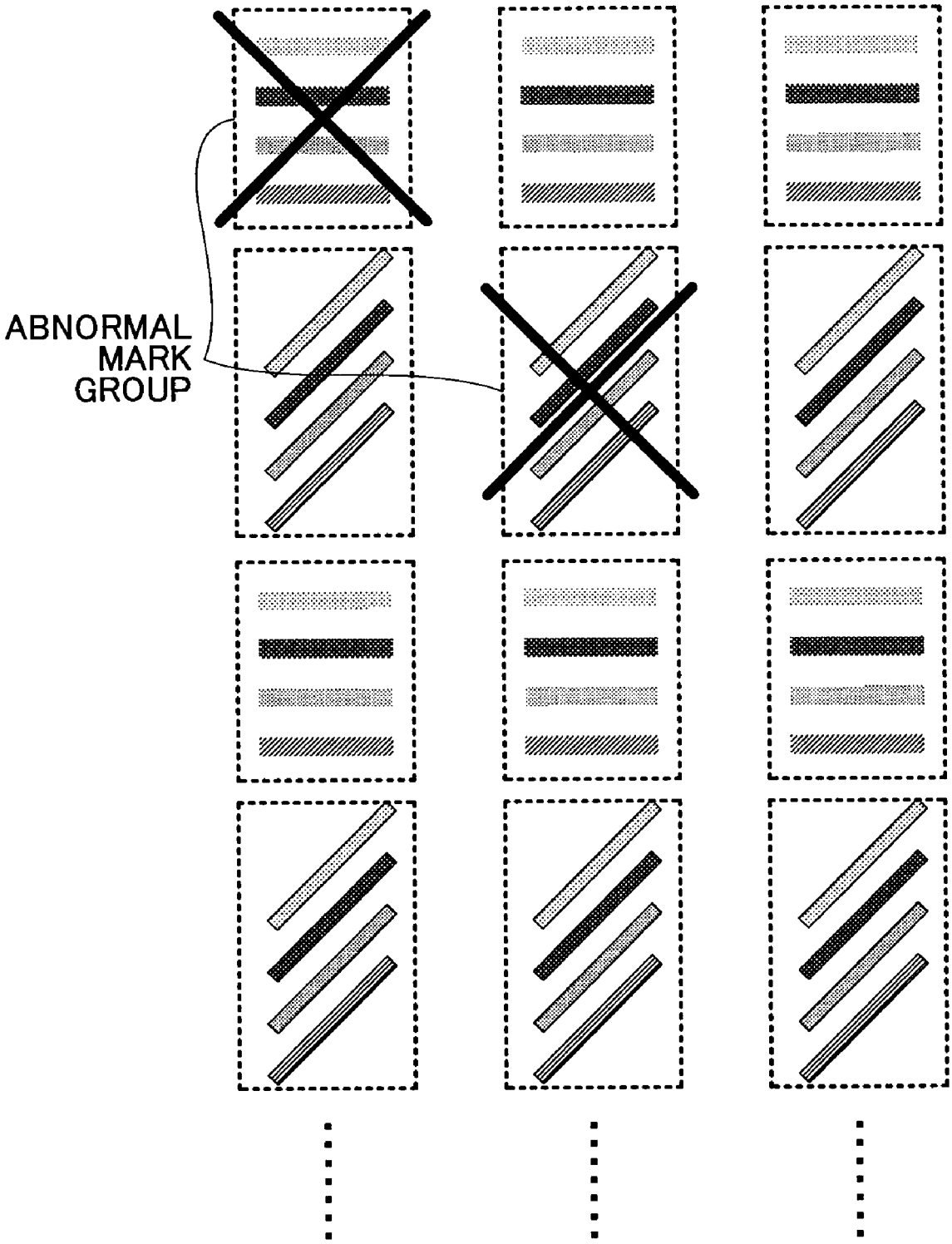

FIG. 4 is a diagram for illustrating a method of correcting misregistration performed in the image forming apparatus according to the first embodiment of the present invention. FIG. 5 is a flowchart of the method of correcting misregistration. FIGS. 6A through 6D are diagrams for illustrating abnormal mark groups to be excluded in the method of correcting misregistration.

A description is given below, with reference to FIG. 4, FIG. 5, and FIGS. 6A through 6D, of an operational procedure for the method of correcting misregistration with respect to the image forming apparatus configured as described above according to the first embodiment of the present invention.

In step S1 of FIG. 5, the position information of one set of groups of horizontal line marks (three mark groups) are obtained and stored in a memory. In step S2, the number of detected positions of the one set of three groups of horizontal line marks is stored in the memory. In step S3, the position information of one set of three groups of oblique line marks are obtained and stored in the memory. In step S4, the number of detected positions of the one set of three groups of oblique line marks is stored in the memory. The one set of three groups of horizontal line marks and the one set of three groups of oblique line marks form a single pattern set.

In step S5, it is determined whether there is an abnormal mark group (a mark group whose number of detected positions is other than a prescribed number) based on the number of detected positions of the two sets of mark groups, that is, one pattern set, stored in the memory. If there is no abnormal mark group (NO in step S5), in step S17, the amount of misregistration is calculated both in the main scanning direction and in the sub scanning direction based on all the mark groups of the one pattern set.

If there is one or more abnormal mark groups (YES in step S5), in step S6, it is determined whether only one of the groups of oblique line marks is abnormal. If only one of the groups of oblique line marks is abnormal (YES in step S6), in step S7, the amount of misregistration is calculated both in the main scanning direction and in the sub scanning direction, excluding the abnormal group of oblique line marks. This is, for example, when only a group of oblique line marks (an oblique line mark group) <6> is abnormal in FIG. 4, such as in the case of FIG. 6A.

If there is an abnormal mark group other than the one of the groups of oblique line marks (NO in step S6), in step S8, it is determined whether only two of the groups of oblique line marks are abnormal. If only two of the groups of oblique line marks are abnormal (YES in step S8), in step S9, the amount of misregistration is calculated only in the sub scanning direction. This is, for example, when only oblique line mark groups <4> and <5> are abnormal in FIG. 4, such as in the case of FIG. 6B. The amount of misregistration in the main scanning direction is not calculated because of low reliability of the position information in the main scanning direction.

If there is an abnormality in other than the oblique line mark groups (NO in step S8), in step S10, it is determined whether only two of the groups of horizontal line marks are abnormal. If only two of the groups of horizontal line marks are abnormal (YES in step S10), in step S9, the amount of misregistration is calculated only in the sub scanning direction. This is, for example, when only a horizontal line mark group <1> and a horizontal line mark group <2> are abnormal, such as in the case of FIG. 6C. In this case, the amount of misregistration in the main scanning direction is not calculated either because of low reliability of the position information in the main scanning direction. If it is not the case that only two of the groups of horizontal line marks are abnormal (NO in step S10), in step S11, it is determined whether the group of horizontal line marks and the group of oblique line marks in the same column are abnormal.

If there is a column where the group of horizontal line marks and the group of oblique line marks are both abnormal (YES in step S11), in step S12, the amount of misregistration is calculated both in the main scanning direction and in the sub scanning direction, excluding the group of horizontal line marks and the group of oblique line marks of the column. This is, for example, when a horizontal line mark group <2> and the oblique line mark group <5> are abnormal in FIG. 4, such as in the case of FIG. 6D.

If there is one or more abnormal mark groups, but the one or more abnormal mark groups are not one or two oblique line mark groups, two horizontal line mark groups, or one horizontal line mark group and one oblique line mark group of the same column, the amount of misregistration is not calculated from the position information of this pattern set (step S13).

In step S14, it is determined whether the position information and the number of detected positions of the mark groups of the last set are stored in the memory. If not (NO in step S14), the operation returns to step S1. If the position information and the number of detected positions of the mark groups of the last set are stored in the memory (YES in step S14), in step S15, the amounts of misregistration of the pattern sets are averaged in the main scanning direction and in the sub scanning direction.

In step S16, the calculation results of various amounts of misregistration are stored in the memory, and the misregistration correction operation ends.

In the above-described configuration, the detection marks are formed on the belt conveyor 5. Alternatively, the endless belt on which images are formed may be an intermediate transfer belt. Further, in the above described case, the slit 21 is used in the image detecting part. However, the configuration is not limited to this, and the slit 21 may not be used as long as the detection marks can be detected. Further, in the above-described case, the detection pattern is drawn vertically and horizontally. However, the configuration is not limited to this, and the detection pattern may have an inverted V shape.

As described above, according to the first embodiment of the present invention, the image forming apparatus is configured to create multiple sets of patterns for misregistration correction on an endless belt; detect the positions of marks and store the position information on a pattern set basis, that is, for each pattern set; count the number of detected positions on a mark group basis, that is, for each mark group; and calculate the amount of misregistration excluding the position information of an abnormal mark group on a pattern set basis, that is, for each pattern set. Accordingly, misregistration is prevented from occurring, and the misregistration correction time is prevented from being prolonged, thus resulting in better usability.

Second Embodiment

According to a second embodiment of the present invention, there is provided an image forming apparatus configured to create multiple sets of patterns for misregistration correction on an endless belt; detect and store the positions of all mark groups; and calculate the amount of misregistration excluding an abnormal mark group.

The image forming apparatus according to the second embodiment of the present invention has the same basic configuration as the conventional one.

Figure 9A:
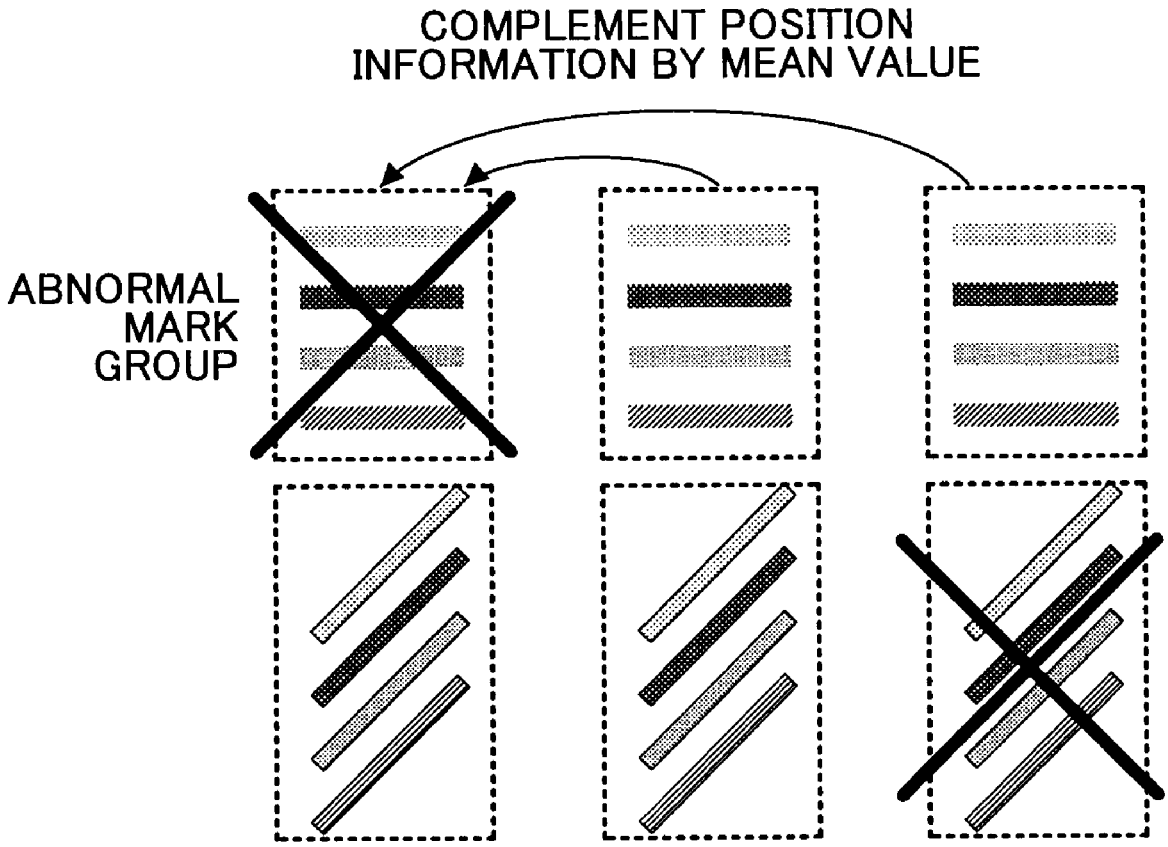
FIGS. 9A through 9C are diagrams for illustrating a method of complementing the position information of an abnormal mark group in the method of correcting misregistration performed in the image forming apparatus according to the second embodiment of the present invention.
Figure 9B:
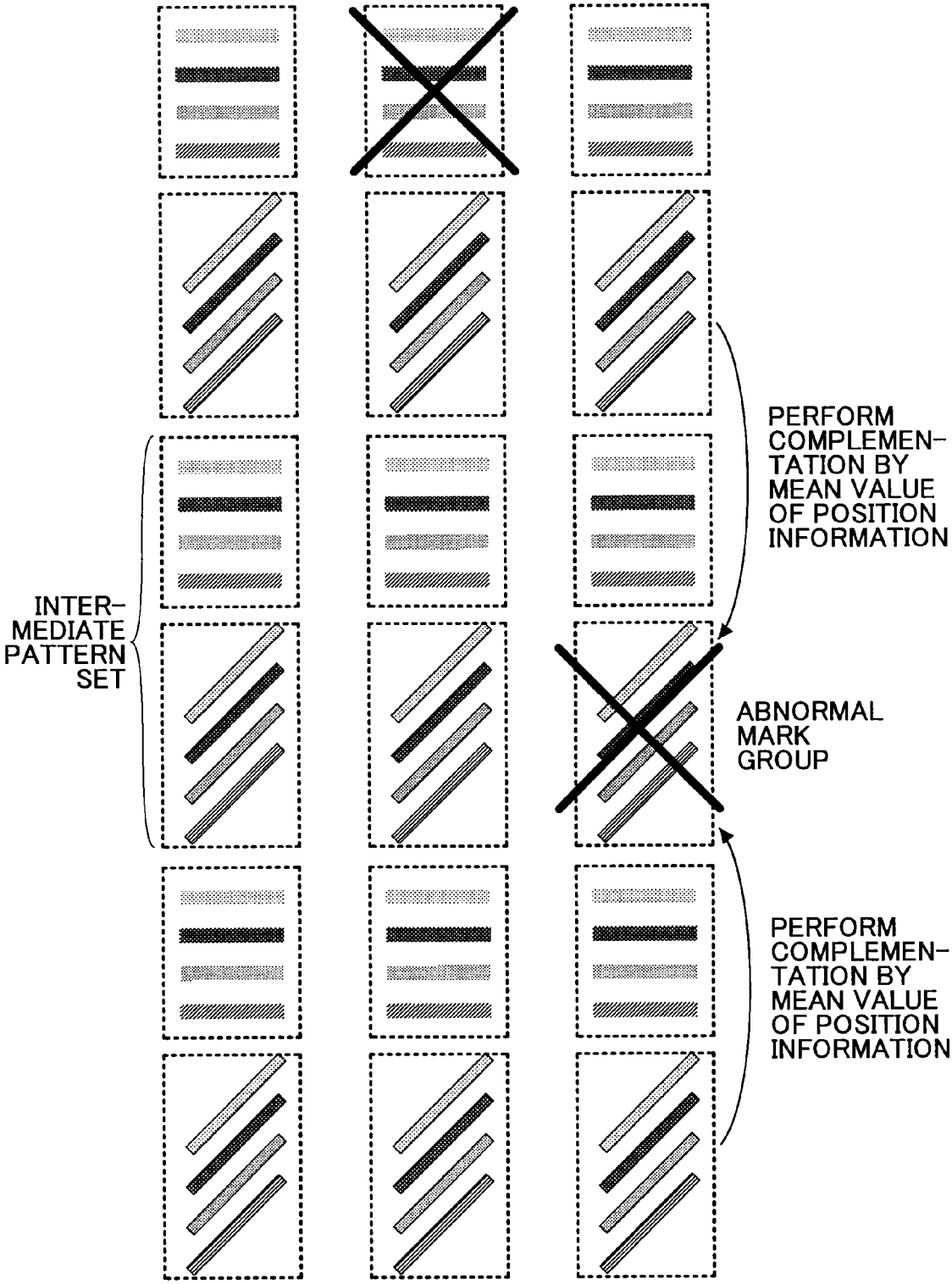
Figure 9C:
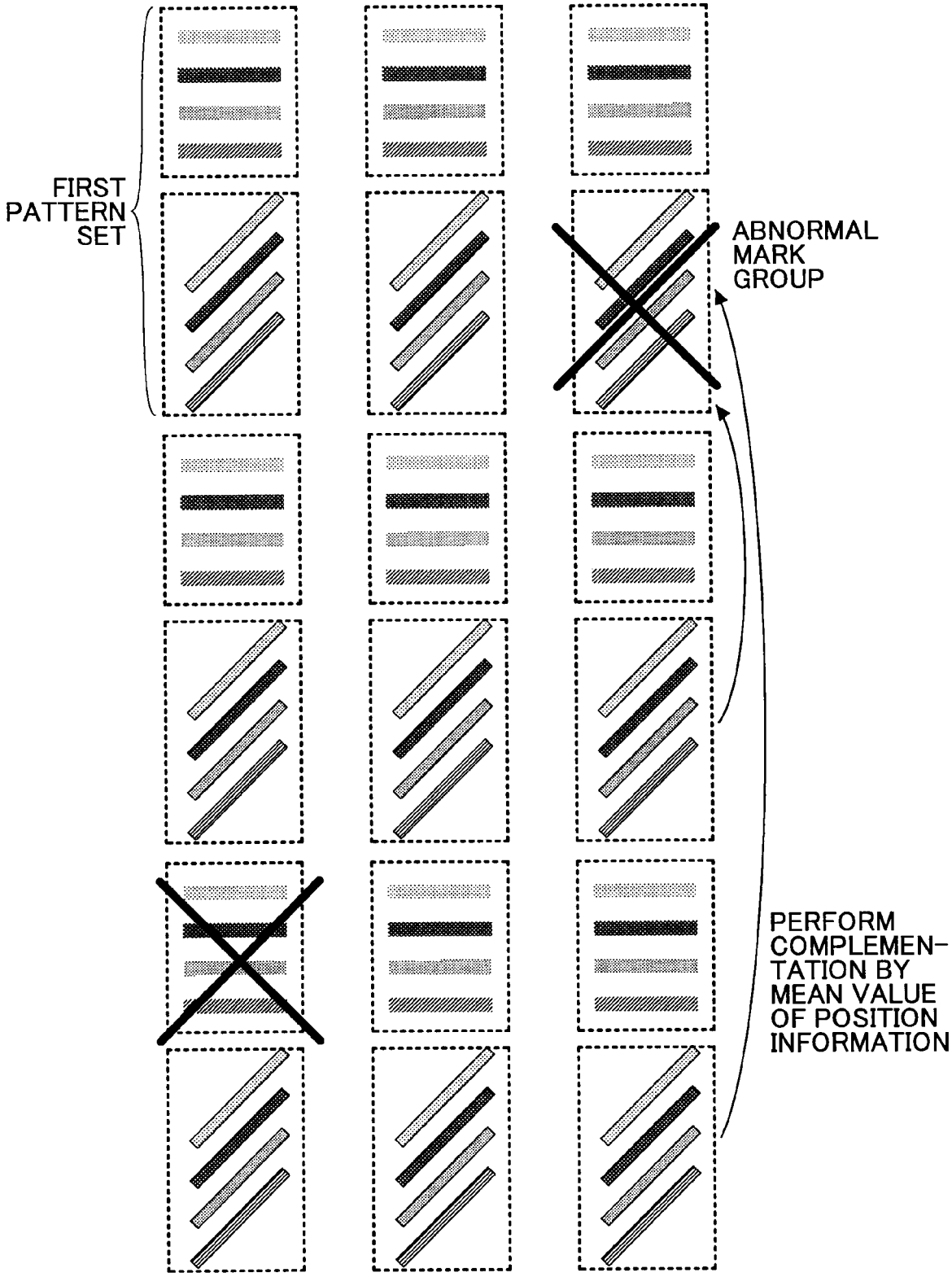

FIG. 7 is a flowchart of a method of controlling a misregistration correction operation. FIGS. 8A through 8D are diagrams for illustrating abnormal mark groups to be excluded in a method of correcting misregistration. FIGS. 9A through 9C are diagrams for illustrating a method of complementing the position information of an abnormal mark group in the method of correcting misregistration.

A description is given, with reference to FIG. 7, FIGS. 8A through 8D, and FIGS. 9A through 9C, of an operational procedure for the method of correcting misregistration.

In step S21 of FIG. 7, the position information and the number of detected positions of one set of groups of horizontal line marks and the position information and the number of detected positions of one set of groups of oblique line marks are stored in a memory.

In step S22, it is determined whether the position information and the number of detected positions of the last set of mark groups are stored in the memory. If data on the position information and the numbers of detected positions of all mark groups are stored (YES in step S22), the operation proceeds to step S23. If not (NO in step S22), the operation returns to step S21, and steps S21 and S22 are repeated.

In step S23, it is determined whether there is any abnormal mark group (a mark group whose number of detected positions is other than a prescribed number). If there is no abnormal mark group (NO in step S23), the position information data of all marks have been obtained without excess or deficiency. Accordingly, in step S24, the amount of misregistration is calculated both in the main scanning direction and in the sub scanning direction, and in step S25, the amounts of misregistration are stored in the memory and the operation ends.

If there is one or more abnormal mark groups (YES in step S23), in step S26, it is determined whether one or more abnormal mark groups are in the center column only. If one or more abnormal mark groups are in the center column only (YES in step S26), in step S27, the amount of misregistration is calculated without the position information data of the center column at the time of calculating the amount of misregistration in the sub scanning direction. This is, for example, when only the horizontal line mark group <2> and the oblique line mark group <5> in the center column are abnormal in FIG. 4, such as in the case of FIG. 8A.

If it is not the case that one or more abnormal mark groups are in the center column only (NO in step S26), in step S28, it is determined whether one or more abnormal mark groups are in one of the end columns only. If one or more abnormal mark groups are in one of the end columns only (YES in step S28), in step S29, the amount of misregistration in the main scanning direction is calculated without the position information data of the one of the end columns. Specifically, the amount of misregistration in the main scanning direction is calculated using the position information data of the center column and the position information data of the other one of the end columns. This is, for example, when only the oblique line mark group <6> is abnormal, such as in the case of FIG. 8B.

If it is not the case that one or more abnormal mark groups are in one of the end columns only (NO in step S28), in step S30, it is determined with respect to each pattern set whether only one of the groups of horizontal line marks is abnormal. If only one of the groups of horizontal line marks is abnormal in any pattern set (YES in step S30), in step S31, the position information of the abnormal group of horizontal line marks is complemented by the position information normally obtained from the other (normal) groups of horizontal line marks in the operation in the pattern set including the abnormal group of horizontal line marks. Specifically, the amount of misregistration is calculated both in the main scanning direction and in the sub scanning direction using the mean value (average) of the position information of the normal groups of horizontal line marks as the position information of the abnormal group of horizontal line marks. This is, for example, when only the horizontal line mark group <1> is abnormal, such as in the case of FIG. 8C. The position information is complemented as shown in FIG. 9A.

If there is no pattern set in which only one of the groups of horizontal line marks is abnormal (NO in step S30), in step S32, it is determined with respect to each pattern set whether only one of the groups of oblique line marks is abnormal. If only one of the groups of oblique line marks is abnormal in any pattern set (YES in step S32), in step S33, it is determined whether the pattern set including the abnormal group of oblique line marks is the first (leading or initial) pattern set. If the pattern set is not the first pattern set (NO in step S33), in step S34, the position information of the abnormal group of oblique line marks of the pattern set is calculated (determined) from the mean value (average) of the position information of the corresponding groups of oblique line marks of the previous and subsequent pattern sets, and the amount of misregistration is calculated both in the main scanning direction and in the sub scanning direction using the determined position information. For example, the position information is complemented as shown in FIG. 9B.

If the pattern set including the abnormal group of oblique line marks is the first pattern set (YES in step S33), in step S35, the position information of the abnormal group of oblique line marks of the first pattern set is determined from the mean value (average) of the position information of the corresponding groups of oblique line marks of the second and third pattern sets, and the amount of misregistration is calculated both in the main scanning direction and in the sub scanning direction using the determined position information. For example, the position information is complemented as shown in FIG. 9C. If abnormal mark groups are in multiple columns and include both a group of horizontal line marks and a group of oblique line marks in a single pattern set, the operation ends without calculating the amount of misregistration. This is, for example, when the horizontal line mark group <1> and the oblique line mark group <5> are abnormal, such as in the case of FIG. 8D. In step S25, the amounts of misregistration in the main and sub scanning directions calculated in step S24, S27, S29, S31, S34, or S35 are stored in the memory, and the operation ends.

As described above, according to the second embodiment of the present invention, the image forming apparatus is configured to create multiple sets of patterns for misregistration correction on an endless belt; detect and store the positions of all mark groups; and calculate the amount of misregistration excluding an abnormal mark group. Accordingly, it is possible to correct misregistration in a short time.

Thus, according to one embodiment of the present invention, there is provided an image forming apparatus that is the most suitable as an image forming apparatus, such as a printer, of an electrophotography type that performs misregistration correction in producing a visualized image by superposing multiple colors.

Thus, according to one aspect of the present invention, misregistration is prevented from occurring, and the misregistration correction time is prevented from being prolonged, thus resulting in better usability.

The present invention is not limited to the specifically disclosed embodiments, and variations and modifications may be made without departing from the scope of the present invention.

The present application is based on Japanese Priority Patent Applications No. 2007-055507, filed on Mar. 6, 2007, and No. 2007-181624, filed on Jul. 11, 2007, the entire contents of which are hereby incorporated by reference.

What is claimed is:

1. A misregistration correcting unit correcting a misregistration of an image on an endless belt in an electrophotographic image forming apparatus, the misregistration correcting unit comprising:

an image creation part configured to create a plurality of pattern sets for correcting the misregistration on the endless belt, the pattern sets each including a pattern of a plurality of mark groups arranged in a plurality of columns and a plurality of rows, the mark groups each being one of a horizontal line mark group formed of a plurality of marks each formed of a horizontal line segment and an oblique line mark group formed of a plurality of marks each formed of an oblique line segment;

a position detecting part configured to detect positions of the marks;

a position detection counting part configured to count a number of the detected positions of each of the mark groups and detect an abnormal one or more of the mark groups whose numbers of the detected positions are other than a prescribed number;

a detection result storing part configured to store position information, the position information being information on the positions of the marks detected by the position detecting part; and a misregistration calculating part configured to calculate an amount of the misregistration based on the stored position information excluding the position information of the abnormal one or more of the mark groups.

2. The misregistration correcting unit as claimed in claim 1, wherein the misregistration calculating part comprises a part configured to calculate the amount of the misregistration by excluding the position information of the abnormal one or more of the mark groups on a pattern set basis.

3. The misregistration correcting unit as claimed in claim 2, wherein the misregistration calculating part further comprises a part configured to calculate the amount of the misregistration, in one or more of the pattern sets where only one of the oblique line mark groups is abnormal, by excluding the position information of the abnormal one of the oblique line mark groups.

4. The misregistration correcting unit as claimed in claim 2, wherein the misregistration calculating part further comprises a part configured to calculate the amount of the misregistration only in a sub scanning direction in one or more of the pattern sets where only two or more of the oblique line mark groups are abnormal and in one or more of the pattern sets where only two or more of the horizontal line mark groups are abnormal.

5. The misregistration correcting unit as claimed in claim 2, wherein the misregistration calculating part further comprises a part configured to calculate the amount of the misregistration, in one or more of the pattern sets where an abnormal one of the horizontal line mark groups and an abnormal one of the oblique line mark groups are in a same column, by excluding the position information of the abnormal one of the horizontal line mark groups and the abnormal one of the oblique line mark groups.

6. The misregistration correcting unit as claimed in claim 1, wherein the misregistration calculating part comprises a part configured to calculate the amount of the misregistration by excluding the position information of the abnormal one or more of the mark groups from the position information of the mark groups of each of the pattern sets.

7. The misregistration correcting unit as claimed in claim 6, wherein the misregistration calculating part further comprises a part configured to calculate the amount of the misregistration in a sub scanning direction, in response to the abnormal one or more of the mark groups being in an inner column only, by excluding the position information of the inner column.

8. The misregistration correcting unit as claimed in claim 6, wherein the misregistration calculating part further comprises a part configured to calculate the amount of the misregistration, in response to the abnormal one or more of the mark groups being in only one of end columns, by excluding the position information of the one of the end columns.

9. The misregistration correcting unit as claimed in claim 8, wherein the misregistration calculating part further comprises a part configured to calculate the amount of the misregistration in a main scanning direction by excluding the position information of a column including the abnormal one or more of the mark groups.

10. The misregistration correcting unit as claimed in claim 6, wherein the misregistration calculating part further comprises a part configured to calculate the amount of the misregistration, in one or more of the pattern sets where only one of the horizontal line mark groups is abnormal, by complementing the position information of the abnormal one of the horizontal line mark groups by the position information of the other horizontal line mark groups.

11. The misregistration correcting unit as claimed in claim 10, wherein the misregistration calculating part further comprises a part configured to calculate the amount of the misregistration, in response to only one of the mark groups being abnormal, by using a mean value of the position information of the other normal mark groups as complementary position information.

12. The misregistration correcting unit as claimed in claim 6, wherein the misregistration calculating part further comprises a part configured to calculate the amount of the misregistration, in one or more of the pattern sets where only one of the oblique line mark groups is abnormal, by complementing the position information of the abnormal one of the oblique line mark groups by the position information of a corresponding one of the oblique line mark groups of each of a previous one and a subsequent one of the pattern sets.

13. The misregistration correcting unit as claimed in claim 12, wherein the misregistration calculating part further comprises a part configured to calculate the amount of the misregistration, in response to only one of the oblique line mark groups being abnormal in a first one of the pattern sets, by calculating complementary position information from the position information of the corresponding one of the oblique line mark groups of each of a second one and a third one of the pattern sets, the second one following the first one and the third one following the second one.

14. The misregistration correcting unit as claimed in claim 12, wherein the misregistration calculating part further comprises a part configured to calculate the amount of the misregistration, in response to only one of the oblique line mark groups being abnormal in an intermediate one of the pattern sets, by calculating complementary position information from the position information of the corresponding one of the oblique line mark groups of each of the pattern sets immediately before and after the intermediate one.

15. An image forming apparatus, comprising:

the misregistration correcting unit as set forth in claim 1.

16. A misregistration correction controlling method correcting a misregistration of an image on an endless belt in an electrophotographic image forming apparatus, the misregistration correction controlling method comprising:

creating a plurality of pattern sets for correcting the misregistration on the endless belt, the pattern sets each including a pattern of a plurality of mark groups arranged in a plurality of columns and a plurality of rows, the mark groups each being one of a horizontal line mark group formed of a plurality of marks each formed of a horizontal line segment and an oblique line mark group formed of a plurality of marks each formed of an oblique line segment;

detecting positions of the marks and storing position information on a pattern set basis, the position information being information on the positions of the marks;

counting a number of the detected positions of each of the mark groups and determining whether there is an abnormal mark group whose number of the detected positions is other than a prescribed number;

calculating an amount of the misregistration, in one or more of the pattern sets where only one of the oblique line mark groups is abnormal, by excluding the position information of the abnormal one of the oblique line mark groups;

calculating the amount of the misregistration only in a sub scanning direction in one or more of the pattern sets where only two or more of the oblique line mark groups are abnormal and in one or more of the pattern sets where only two or more of the horizontal line mark groups are abnormal; and calculating the amount of the misregistration, in one or more of the pattern sets where an abnormal one of the horizontal line mark groups and an abnormal one of the oblique line mark groups are in a same column, by excluding the position information of the abnormal one of the horizontal line mark groups and the abnormal one of the oblique line mark groups.

17. A misregistration correction controlling method correcting a misregistration of an image on an endless belt in an electrophotographic image forming apparatus, the misregistration correction controlling method comprising:

creating a plurality of pattern sets for correcting the misregistration on the endless belt, the pattern sets each including a pattern of a plurality of mark groups arranged in a plurality of columns and a plurality of rows, the mark groups each being one of a horizontal line mark group formed of a plurality of marks each formed of a horizontal line segment and an oblique line mark group formed of a plurality of marks each formed of an oblique line segment;

detecting positions of the marks of each of the pattern sets and storing position information, the position information being information on the positions of the marks;

counting a number of the detected positions of each of the mark groups and determining whether there is an abnormal mark group whose number of the detected positions is other than a prescribed number;

calculating an amount of the misregistration in a sub scanning direction, in response to the abnormal mark group being in an inner column only, by excluding the position information of the inner column;

calculating the amount of the misregistration in a main scanning direction, in response to the abnormal mark group being in only one of end columns, by excluding the position information of the one of the end columns;

calculating the amount of the misregistration, in one or more of the pattern sets where only one of the horizontal line mark groups is abnormal, by complementing the position information of the abnormal one of the horizontal line mark groups by the position information of the other horizontal line mark groups;

calculating the amount of the misregistration, in response to only one of the mark groups being abnormal, by using a mean value of the position information of the other normal mark groups as complementary position information;

calculating the amount of the misregistration, in one or more of the pattern sets where only one of the oblique line mark groups is abnormal, by complementing the position information of the abnormal one of the oblique line mark groups by the position information of a corresponding one of the oblique line mark groups of each of a previous one and a subsequent one of the pattern sets;

calculating the amount of the misregistration, in response to only one of the oblique line mark groups being abnormal in a first one of the pattern sets, by calculating complementary position information from the position information of the corresponding one of the oblique line mark groups of each of a second one and a third one of the pattern sets, the second one following the first one and the third one following the second one; and calculating the amount of the misregistration, in response to only one of the oblique line mark groups being abnormal in an intermediate one of the pattern sets, by calculating complementary position information from the position information of the corresponding one of the oblique line mark groups of each of the pattern sets immediately before and after the intermediate one.

* * * * *